United States Patent [19]

Edele

[11] 4,380,954

[45] Apr. 26, 1983

[54] METHOD AND APPARATUS FOR CONTROLLING THE PRESSURE EXERTED ON A MATERIAL WEB IN THE ROLLER NIP OF A ROLLING MILL

[75] Inventor: Eugen Edele, Reutlingen, Fed. Rep. of Germany

[73] Assignee: Kleinewefers GmbH, Krefeld, Fed. Rep. of Germany

[21] Appl. No.: 231,944

[22] Filed: Feb. 5, 1981

[30] Foreign Application Priority Data

Feb. 28, 1980 [DE] Fed. Rep. of Germany ..... 3007452

[51] Int. Cl.[3] ..... B30B 13/00; B30B 3/04

[52] U.S. Cl. ..... 100/35; 100/47; 100/50; 100/170; 72/243; 73/862.55

[58] Field of Search ..... 100/35, 43, 47, 50, 100/168, 169, 170; 72/243; 73/862.55

[56] References Cited

U.S. PATENT DOCUMENTS 3,049,004 8/1962 McNamara ..... 73/862.55
3,111,047 11/1963 Metzger ..... 100/170 X
3,327,508 6/1967 Brown ..... 72/243 X
3,777,656 12/1973 Müller ..... 100/170
4,290,351 9/1981 Pav et al. ..... 100/47

FOREIGN PATENT DOCUMENTS 2623492 12/1977 Fed. Rep. of Germany .
2744990 4/1979 Fed. Rep. of Germany .

*Primary Examiner*—Peter Feldman
*Attorney, Agent, or Firm*—Wigman & Cohen

[57] ABSTRACT

Disclosed herein are a method and apparatus for the compression treatment of a material web in a calender or the like, wherein the pressure in the roller nip can be precisely set and regulated by the comparison between the set point value and the actual value of the pressure in the roller nip. The actual pressure is determined by a pressure measuring element mounted on a piston supported against the rollers of the calender or in the bearings of such a roller, taking into consideration the weight of the directly supported roller.

12 Claims, 2 Drawing Figures

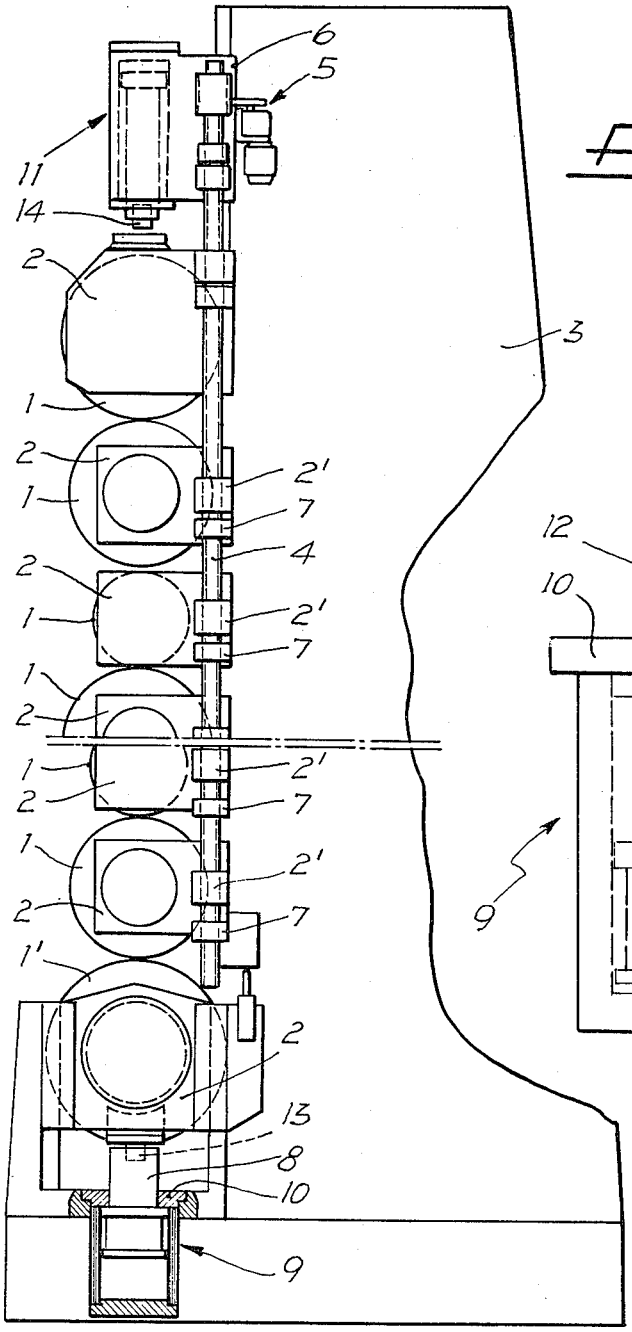
Fig. 1.
Fig. 2.
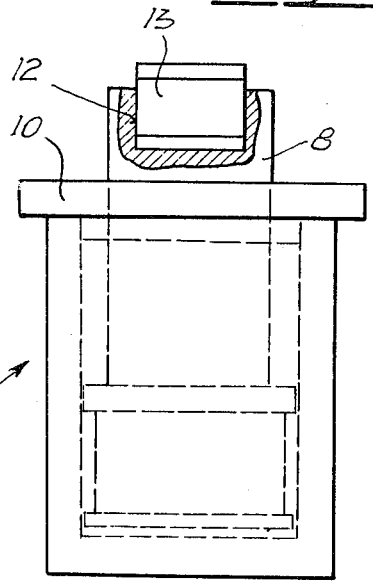

METHOD AND APPARATUS FOR CONTROLLING THE PRESSURE EXERTED ON A MATERIAL WEB IN THE ROLLER NIP OF A ROLLING MILL

BACKGROUND OF THE INVENTION

The invention relates to a method for controlling or regulating the pressure exerted on a material web in the nip between two cooperating rollers of a calender or the like having a roller loading device, and to a calender wherein the bearings of the lowermost roller are supported by a working cylinder which can be rapidly released from its roller supporting position and having a device for regulating the pressure exerted on a material web in the roller nip.

In conventional rolling mills for the compression treatment of webs, such as calenders and smoothing rollers, the pressure exerted on the material web in the roller nip cannot be precisely adjusted to a specific value, as in many cases would be desirable. This is true not only for embodiments in which in addition to the weight of the rollers a load is produced by the working cylinders supported against the lowermost roller, but also for embodiments in which the additional roller load is produced by working cylinders which press against the uppermost roller. It is true that in the latter instance the force acting as the additional load can be set with much more precision than in the first instance, where the working cylinders must also simultaneously produce the stroke force compensating for the weight of the roller aggregate. The additional load thus represents only a fraction of the entire stroke force of the operating cylinders. Lack of precision resulting from friction or a tilting of the slidably guided bearings, however, here, too, lead to deviations between the additional pressure prevailing in the roller nip and the additional roller load produced by the loading device. This lack of precision becomes most important when material webs are treated whose quality experiences significant impairment because of an incorrectly set pressure in the roller nip, resulting, for example, from a loss of volume which can appear in a paper web when the pressure in the roller nip is too high.

OBJECTS AND SUMMARY OF THE INVENTION

An object of the invention is to create a method for controlling or regulating the pressure exerted on a material web in the nip between two rollers which makes it possible to maintain the desired value with great precision yet without requiring a great expense. This object is achieved by the method of the invention, wherein the support force provided by the working cylinder is measured and the actual value of the pressure in the nip is determined taking into account the weight of the directly supported roller and any deviation between this actual value and the desired set point value is eliminated by adjusting the force of the loading device.

The pressure prevailing in the roller nip differs from the support force exerted by the working cylinders which support the lowermost roller only by the weight of the bottom roller, an amount which is precisely known. Therefore, the weight of the bottom roller need only be subtracted from the measurement value in order to obtain the measurement value of the pressure prevailing in the roller nip. Because the support force of the working cylinders can be measured very precisely, for example by means of respective pressure pickups, in this manner the pressure in the roller nip can also be determined with great precision. Since the expense for such devices is lowand since by using a set point value—actual value comparison a possible deviation from the set point value can be eliminated by correspondingly changing the force of the working cylinders of the loading device, the expense for controlling or regulating the pressure in the roller nip is not very great. If the rolling mill has a plurality of rollers arranged one above the other and, therefore, has a plurality of roller nips, then it is sufficient to precisely set the pressure in the lowermost roller nip, because the pressure in the remaining roller nips is less and can therefore not lead to an excessive load on the material web.

A further object of the invention is to construct a rolling mill with an associated loading device in such a manner that a measurement of the pressure in the roller nip and a corresponding regulation or control can be performed in the simplest possible manner. This object is achieved by arranging a pressure measuring device between the piston of the working cylinder and the lowermost roller and providing means for comparing the obtained actual value of the pressure with the desired set point value and eliminating any difference by changing the force applied by the roller loading device. The insertion of a pressure measuring element in the end of the piston of the working cylinders directed toward the roller to be supported or in the bearing of this roller which is supported on the piston can be achieved very simply from a design point of view and is also advantageous in that a direct measurement of the support force is given which differs from the pressure force in the roller nip only by the weight of the directly supported roller. With a measuring element constructed in this manner, a simple correction can therefore determine the total pressure force effective in the roller nip.

In a preferred embodiment a pressure pickup is provided as the pressure measuring element, because it is very simple to build it into the piston. For example, the piston may include a depression in the frontal side facing the roller to receive the pressure measuring element and serving as a mounting therefor. However, a pressure measuring ring is very suitable for this purpose as well.

It is particularly advantageous for the pressure measuring element to be removably positioned in the mounting. For then replacement is a simple matter in the event of malfunction or damage, and one can also, for example, remove the pressure pickups after an adjustment of the rolling mill or only use them for a new adjustment during maintenance.

In order to make it unnecessary to first deduct the weight of the lowermost roller from the measurement value when determining the pressure in the roller nip, the pressure measuring element or the subsequently arranged circuit can be formed with a zero point shifted to correspond to the weight of the lowermost roller.

In order to be able to precisely measure the additional load often produced by working cylinders which press on the bearings of the uppermost roller, which is significant both in determining the line pressure in the roller nip and also, for example, to provide an equal adjustment of the load on both ends of the uppermost roller, it is advantageous to also arrange pressure measuring elements on the piston of the loading device which presses on the bearings of the uppermost roller or on the portions of the bearings acted upon by this piston. Preferably, they should also be removable.

The invention is described below in greater detail hereinafter with the aid of an exemplary embodiment illustrated in the drawing.

BRIEF DESCRIPTION OF THE DRAWINGS

FIG. 1 shows a schematic, partial section of a side view of the exemplary embodiment; and FIG. 2 is an enlarged portion of FIG. 1.

DETAILED DESCRIPTION OF A PREFERRED EMBODIMENT

A super calender for glazing paper webs includes a plurality of rollers 1 having horizontal axes and being arranged one above the other. The ends of these rollers 1 are mounted in respective bearing side plates or supports 2. All bearing supports 2 are guided in the calender frame 3 so as to be shiftable in a vertical direction. On each side of the roller aggregate adjacent the bearing supports 2 are arranged respective suspended spindles 4 which penetrate the aligned bores of lugs 2' provided on each bearing support with the exception of the bearing support of the lowermost roller. The upper end of each suspended spindle coupled with a rotary drive 5 is supported on a lateral yoke 6. Respective nuts 7 on the suspended spindles beneath the lugs of the bearing supports define the size of the roller nip when the central rollers and the uppermost roller hang from the suspended spindles 4.

The two bearing supports 2 of the lowermost roller 1' are supported on respective vertically movable pistons 8 of an hydraulic cylinder 9 which, in turn, is supported by the calender frame 3.

During operation of the calender the lowermost roller 1' is located in a structurally set position such that in the operating position a shoulder of the piston 8 presses against a cover 10 of the hydraulic cylinder 9 which serves as a stop with a force larger than the roller weight to be supported by the hydraulic cylinder 9. A loading device is arranged above each bearing support 2 of the uppermost roller 1, which loading device is formed by a downwardly acting hydraulic cylinder 11, the pistons of which can downwardly load the bearing support of the uppermost roller lying therebeneath. The lateral yoke 6 supports and connects these loading devices.

A central depression resembling a blind hole is provided in the frontal side of the piston of both hydraulic cylinders 11 facing the bearing of the uppermost roller. This depression forms a mounting for a pressure measuring element, which in this exemplary embodiment is formed as a pressure pickup 14. The mounting allows simple insertion and removal of the pressure pickup, so that it can also be used only temporarily, such as during the adjustment of the calender, should the additional load exerted on the rollers of the calender by the hydraulic cylinder have to be measured during operation. In place of a mounting in the piston end, a mounting could also be provided at the portion of the bearing of the uppermost roller acted on by the piston.

For a rapid release of the roller 1, the pressure medium need only be quickly bled, which allows the rollers to then fall downward.

The end of the piston 8 facing the lowermot roller 1' in each of the two hydraulic cylinders 9 supporting the lowermost roller is provided with a central, blind hole-like depression 12 which is formed as a mounting for respective pressure measurement elements, such as pressure pickups 13, and therefore has a diameter which is adapted to the outside diameter of the pressure pickup 13. The pressure measuring element, however, could also be located in a mounting on the portion of the bearing of the lowermost roller supported on the piston 8. As shown in FIG. 2, the axial length of the depression 12 is somewhat smaller than that of the pressure pickup 13, so that the associated bearing support 2 of the lowermost roller 1' lies directly against the pressure pickup 13. The embodiment of the mounting as a depression allows the pressure pickup 13 to be put in place loosely, which makes exchange or temporary use a simple matter. If no pressure pickup is used in the depression 12, then it is advisable to close it with a cover, whose thickness is preferably selected to be equal to the extension of the pressure pickup beyond the end of the piston, so that the position of the lowermost roller 1' in the operational position is independent of whether the pressure pickups 13 are located in the depressions 12 of the pistons 8 or not.

In the exemplary embodiment, the zero point of the two pressure pickups 13 is suppressed to the point where the weight of the lowermost roller 1' is compensated. The sum of the output signals of the two pressure pickups 13 is thus equal to the force exerted on the lowermost roller 1' by the roller immediately above it. Of course, it would also be possible to take into consideration the weight of the lowermost roller in another manner, such as by subtraction from the measurement value in a circuit arranged behind the pressure pickups 13. Since a very precise value of the force exerted on the lowermost roller 1' by the roller 1 immediately thereabove is associated with the achievement of a specific pressure in the lowermost roller nip, the desired pressure can be set exactly by the use of the hydraulic cylinders 11 based on the value determined by the pressure pickups 13. The load exerted by the hydraulic cylinder 11 on the uppermost roller need only be adjusted so that the force acting in the lowermost nip has the desired value. This can be accomplished by a servicing person reading a display showing the actual value of the force transferred to the lowermost nip and regulating the hydraulic cylinders 11 acting on the uppermost roller in such a manner that the desired value is set at the lowermost nip. One alternative would be to transmit the measurement value to a regulator (not shown) which controls the pressure of the pressure medium in the hydraulic cylinders 11 so that the measured actual value agrees with a set point value given by the regulator. This set point value can, for example, be given by a smoothness measuring device, for example, the one described in Pulp and Paper, Canada, Volume 79, No. 5, May, 1978, pages 46–51; a thickness measuring device, such as the Infrared Thickness Sensor No. 2335 of Measurex; a moisture measuring device, such as the Infrared Moisture Sensor Model No. 2238 manufactured by Measurex; or a shine measuring device, such as the Precision Multisensor Scanner Model 3100 or the "0" Scanner, Model 3101, both from AccuRay Corporation, Columbus, Ohio, which continuously or at certain intervals measures the measurement values of the material web before or after the glazing process.

Although only a preferred embodiment is specifically illustrated and described herein, it will be appreciated that any modifications and variations of the present invention are possible in light of the above teachings and within the purview of the appended claims without departing from the spirit and intended scope of the invention.

What is claimed is:

1. A method for controlling the pressure exerted on a material web in the nip between two cooperating rollers of a rolling mill having a roller loading device, particularly a calender having a plurality of vertically stacked rollers, the lowermost of which is supported on at least one working cylinder which can be rapidly bled, comprising the steps of:

a. measuring the support force supplied by said working cylinder;

b. determining the actual value of the pressure exerted in the nip on the web, while taking into consideration the weight of said roller supported by said working cylinder; and c. eliminating the deviation between said actual value and a desired set point value by changing the force produced by the loading device.

2. A rolling mill, particularly a calender for the compression treatment of a material web, comprising:

a. a plurality of stacked, horizontal rollers mounted in bearings at their respective ends and forming at least one roller nip, said rollers including a lowermost roller of predetermined weight;

b. at least one working cylinder including at least one piston which supports the bearings of said lowermost roller;

c. a pressure measuring element for transferring only the load from the lowermost roller to said piston; and d. means for regulating the pressure exerted on said material web in said roller nip, said regulating means including means for compensating for said predetermined weight of said lowermst roller.

3. The rolling mill according to claim 2, wherein said pressure measuring element is disposed in an end of said piston of said working cylinder facing said roller supported thereby.

4. The rolling mill according to claim 2, wherein said pressure measuring element is disposed between said piston and said roller.

5. The rolling mill according to claims 3 or 4, wherein said pressure measuring element comprises a pressure pickup or a pressure measuring ring.

6. The rolling mill according to claims 3 or 4, further comprising a mounting formed as a depression in a frontal side of said piston facing said lowermost roller, said mounting serving to secure said pressure measuring element to said piston.

7. The rolling mill according to claims 3 or 4, further comprising a mounting for said pressure measuring element, which mounting is formed in said bearing of said lowermost roller.

8. The rolling mill according to claim 7, wherein said pressure measuring element is arranged in said mounting so as to be exchangeable.

9. The rolling mill according to claims 3 or 4, further comprising a set point value indicator embodied as one of a smoothness measuring device, a thickness measuring device, a moisture measuring device and a shine measuring device.

10. The rolling mill according to claim 9, further comprising a loading device which includes a working cylinder having at least one piston for the uppermost roller and a pressure measuring element arranged on the end of said piston facing said uppermost roller and the portion of the bearing of said uppermost roller acted upon by said piston.

11. A method for controlling the pressure on a material web in the nip between two cooperating rollers of a rolling mill having a roller loading device, particularly a calender having a plurality of vertically stacked rollers, the lowermost of which is supported by at least one working cylinder which can be rapidly bled, comprising the steps of:

a. determining the weight of all of the plurality of vertically stacked rollers except the lowermost roller;

b. measuring the force applied by said roller loading device to said plurality of vertically stacked rollers;

c. determining the actual value of the pressure exerted in the nip on the web by adding the determined weight of all of the plurality of vertically stacked rollers except the lowermost roller to the measured force applied by said roller loading device; and d. eliminating the deviation between said actual value and a desired set point value by changing the force applied by said roller loading device.

12. A rolling mill, particularly a calender for the compression treatment of a material web, comprising:

a. a plurality of stacked, horizontal rollers mounted in bearings at their respective ends and forming at least one roller nip;

b. means for determining the weight of all of the plurality of stacked rollers except the lowermost roller;

c. a pressure measuring element for sensing the load applied to the plurality of stacked rollers; and d. means for regulating the pressure exerted on said material web in said roller nip, taking into consideration the weight of the plurality of stacked rollers except the lowermost roller.

* * * * *